US006898261B1

(12) United States Patent
Hunter et al.

(10) Patent No.: US 6,898,261 B1
(45) Date of Patent: May 24, 2005

(54) METHOD AND APPARATUS FOR MONITORING EVENT OCCURRENCES

(75) Inventors: Hillery C. Hunter, Deerfield, IL (US); Ravi Nair, Briarcliff Manor, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 10/725,153

(22) Filed: Dec. 1, 2003

(51) Int. Cl.[7] ..... G07C 3/00
(52) U.S. Cl. ..... 377/15; 377/16; 377/54
(58) Field of Search ..... 377/15, 16, 54

(56) References Cited

U.S. PATENT DOCUMENTS 6,385,274 B1 * 5/2002 Nohara ..... 377/20

* cited by examiner

*Primary Examiner*—Margaret R. Wambach
(74) *Attorney, Agent, or Firm*—Moser, Patterson & Sheridan, LLP; Kin-Wah Tong; Rafael Perez-Pineiro

(57) ABSTRACT

Method and apparatus for monitoring event occurrences, e.g., from an event signal, where a register and a counter are employed. In one embodiment, the register is designed to have a capture bit for capturing the occurrence of a monitored event. The shifting of the stored information within the capture bit to other bit locations within the register is controlled by a shift rate signal operating at a particular interval time period. At the expiration of the interval time period, the stored information in the capture bit is shifted within the register, where the capture bit is now free to detect the next occurrence of the monitored event. Since the register has a finite number of bit locations, as the captured information exists and/or enters the register, a counter is triggered to record the number of occurrences of monitored events. In this fashion, the counter is tracking the number of intervals in which the monitored events have occurred, whereas the register is displaying the most recent information as to which time intervals that the event occurred.

30 Claims, 6 Drawing Sheets

METHOD AND APPARATUS FOR MONITORING EVENT OCCURRENCES

BACKGROUND OF THE INVENTION

1. Field of the Invention

The present invention relates generally to a method and apparatus for monitoring occurrences of events in a computing system and more specifically to a shift register and a counter for counting such occurrences and for providing an occurrence history.

2. Description of the Related Art

It is often important to monitor the performance of a hardware device and/or a software application, e.g., a processor executing a software application. Such monitoring may include the detection of the occurrence of certain events, e.g., misses in a cache, overflows in buffers, functional unit utilization, and so on. Monitoring these events provides insights into the performance of the hardware device and/or software application. For example, a hardware designer may use such records to perform trouble shooting functions or to get ideas about improving the design, while a software designer may use the same to identify inefficiencies in programs and hence to improve its performance.

It is often impractical to count all occurrences of an event during the course of running an application because the resulting count may exceed the capability of reasonably sized counters. For example, the number of clock cycles, and hence the potential number of events, for an application that runs for 6 minutes at 3 Ghz is more than 1 trillion, a number that takes 40 bits to be represented.

Although one can certainly count the occurrences of the monitored event over a period of time, it does not provide information as to when the event occurred within the monitored period. In other words, a simple counting of the monitored event is insufficient to satisfy the monitoring needs for some applications.

Thus, there is a need for a method and apparatus for monitoring occurrences of events and for providing both a reasonable count as well as a reasonable indication of the recent history of the occurrences.

SUMMARY OF THE INVENTION

In one embodiment, the present invention is a method and apparatus for monitoring an event occurrence, e.g., as represented by a 1 or a 0 on a signal line using a register, e.g., a shift register and a counter. The shift register is designed to have at least one capture bit for capturing the occurrence of the monitored event. The shifting of the stored information in the shift register, including the capture bit, is controlled by a shift rate signal which clocks the shift register at a frequency that is a fraction of the frequency of monitoring of the event. Thus the time period of the shift rate signal is a multiple of the time period of the event clock. At the expiration of the shift rate time period, all the stored information in the shift register is shifted, e.g., over to the right. In particular, the leftmost bit in the register, the capture bit is also shifted within the register to the right. A zero bit is fed into the capture bit, which is now free to detect the next occurrence of the monitored event.

Since the register has a finite number of bit locations, as the captured information exits and/or enters the register, a counter is triggered to record the number of occurrences of the monitored events. Thus the counter keeps track of the approximate frequency of occurrence of the event, while the register displays more detailed information about the pattern of occurrence in recent intervals. In this fashion, an efficient and inexpensive apparatus for monitoring occurrences of events is disclosed, capable of providing both a reasonable count as well as a reasonable indication of the recent history of the occurrences.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, wherever possible, to designate identical elements that are common to the figures.

DETAILED DESCRIPTION

Figure 1:
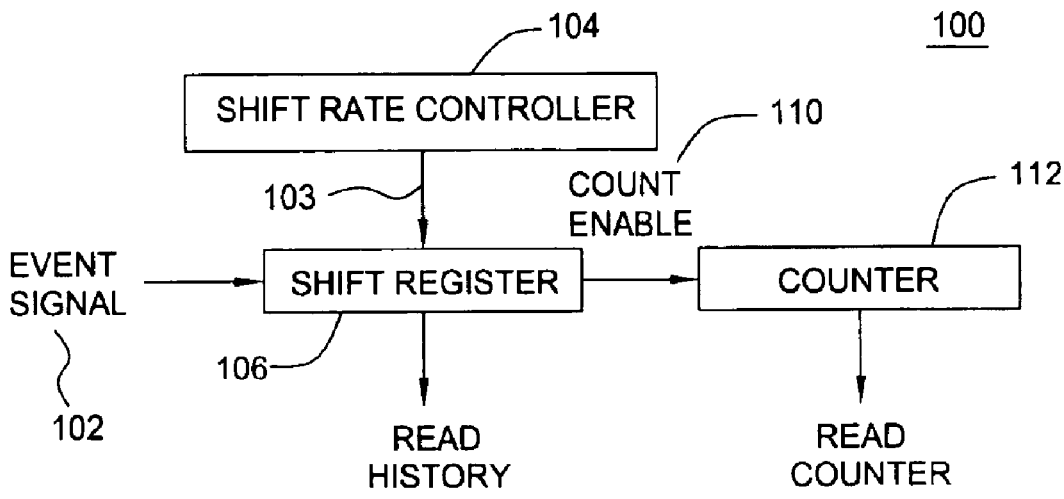
FIG. 1 is a block diagram of an apparatus for monitoring event occurrences in accordance with the present invention.

The present invention discloses a method and apparatus for monitoring event occurrences. In one embodiment, FIG. 1 illustrates an apparatus 100 for monitoring event occurrences, where the apparatus comprises a shift rate controller 104, a shift register 106 and a counter 112.

In operation, the shift register 106 receives an event signal 102. The event signal may comprise one or more monitored events, such as misses in a cache, overflows in buffers, functional unit utilization, issuing particular operation types, taking a particular branch direction, and so on. In one embodiment, the event signal 102 comprises a string of zeros (0) and ones (1) in a binary format, where "0" indicates the absence of the monitored event and "1" indicates the presence of the monitored event or vice versa. However, it should be noted that other formats for the event signal can be used to represent the presence or absence of the monitored event(s). The shift rate controller 104 generates a shift rate signal 103 that controls when the stored information will be shifted within the register 106, thereby effectively controlling the granularity with which occurrences of events are monitored. In other words, the frequency of receiving information from the event signal can be made different from the frequency of receiving the shift rate signal. Certainly, the frequency of receiving information from the event signal can be the same as the frequency of receiving the shift rate signal if appropriate for a particular application. Finally, the count enable signal 110 leaving the shift register 106 is received and used by the counter 112 to count the number of intervals in which the monitored events have occurred. Thus, by reading the counter 112 and the shift register 106, the present invention can track the number of occurrences within the counter, whereas the register displays the most recent information or a pattern history as to which time intervals that the event(s) occurred.

Figure 2:
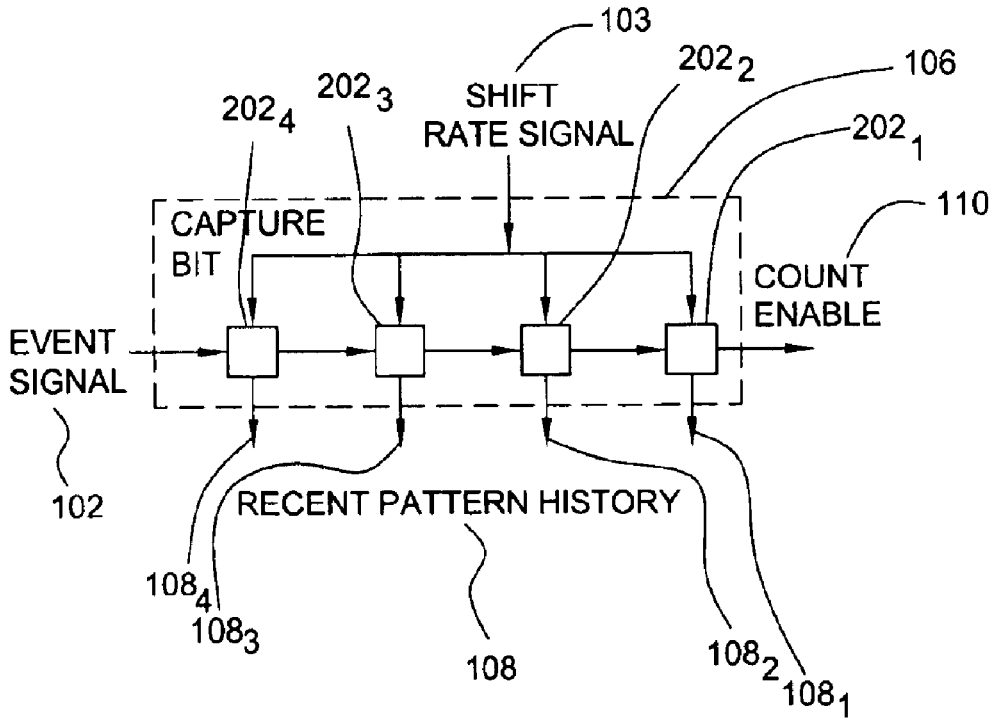
FIG. 2 is a block diagram of an embodiment of a shift register in accordance with the present invention.

FIG. 2 is a block diagram of an embodiment of a shift register 106 in accordance with the present invention. Specifically, FIG. 2 depicts the shift register 106 receiving the shift rate signal 103 and the event signal 102. For illustrative purposes, the shift register 106 contains four bits $\mathbf{202}_1$, $\mathbf{202}_2$, $\mathbf{202}_3$, and $\mathbf{202}_4$ (collectively bits 202). However, it is appreciated that the invention may be used in accordance with a shift register containing more or less bits. Namely, the number of bits used by the register 106 reflects the length of the pattern history that can be recorded and reviewed.

In one embodiment, the leftmost bit $\mathbf{202}_4$ is a capture bit and is coupled to the event signal 102. Capture bit $\mathbf{202}_4$ is coupled to the adjacent storage bit $\mathbf{202}_3$ and storage bits $\mathbf{202}_1$, $\mathbf{202}_2$, and $\mathbf{202}_3$ are controlled by the shift rate signal 103. Each of the bits 202 contains a respective lead $\mathbf{108}_1$, $\mathbf{108}_2$, $\mathbf{108}_3$, and $\mathbf{108}_4$ which when viewed collectively form the recent pattern history 108. In operation, a "1" in the event signal can be captured by the capture bit $\mathbf{202}_4$. However, since the shift rate signal 103 controls the shifting of bits in the register 106, the capture bit $\mathbf{202}_4$, if full, cannot capture another event bit, until the shift rate signal 103 causes the information stored in capture bit $\mathbf{202}_4$ to be shifted into bit $\mathbf{202}_3$. Thus, additional event bits (e.g., Is) are not captured if the capture bit $\mathbf{202}_4$ is still full. A more detailed description is provided below with reference to FIG. 4.

Figure 4:
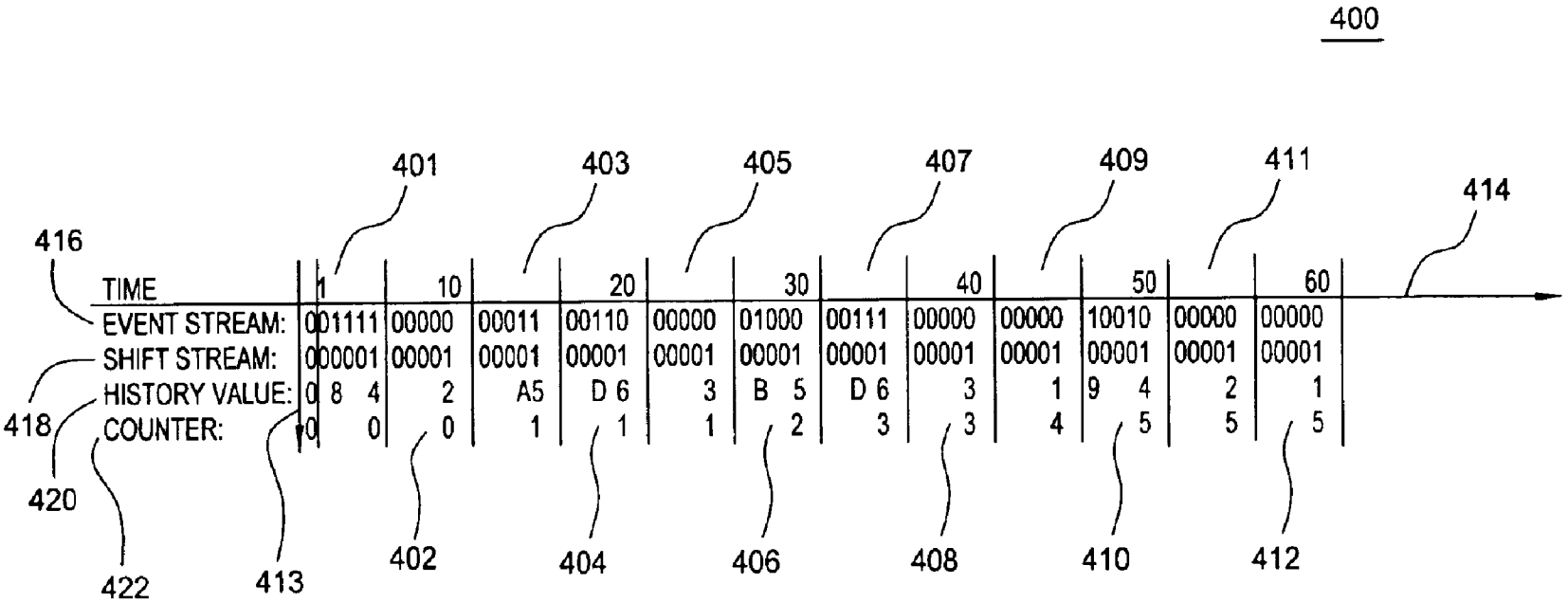
FIG. 4 is a graph in accordance with the embodiment of FIG. 1.

For a clear understanding of the operation of the shift register 106 and counter 112 depicted in FIG. 1, the reader is encouraged to view FIGS. 2 and 4 simultaneously. FIG. 4 is a graph in accordance with the embodiment of FIG. 1.

Specifically, FIG. 4 depicts a timeline of sixty cycles along the x-axis 414. Along the y-axis 413 are an event stream 416, a shift stream 418, a history value 420, and a counter 422. FIG. 4 also depicts the sixty cycles separated into twelve time intervals or periods 401, 402, 403, 404, 405, 406, 407, 408, 409, 410, 411, and 412. Thus each of the periods 401–412 is a five cycle duration, which defines the granularity of the present example.

Referring back to FIG. 2, the shift register 106 has stored within bits 202 a value. Illustratively, the initial value is described as "0000". Periodically the shift rate controller 104 transmits a shift rate signal to shift bits $\mathbf{202}_1$, $\mathbf{202}_2$, and $\mathbf{202}_3$ to the right, thereby effectively causing bit $\mathbf{202}_4$ to shift its information to bit $\mathbf{202}_3$ as well.

Illustratively, the shift rate signal 103 is described herein as transmitting a shift instruction every fifth clock cycle (as readily apparent from the shift stream 418). In the second cycle (located within period 401), an event signal is received and captured by bit $\mathbf{202}_4$. As such a "1" is placed in the capture bit $\mathbf{202}_4$. Each of the remaining bits $\mathbf{202}_1$–$\mathbf{202}_3$ has a "0" therein. Thus, the history value 420 at the second cycle contains a value of "1000" in binary or a hexadecimal value of "8". Although the event signal 416 indicates that monitored events occurred during the third through fifth cycles, these events do not affect the value stored in the capture bit $\mathbf{202}_4$, i.e., these events are ignored. It is only necessary to capture one instance of the monitored event within each time interval as recorded in the capture bit $\mathbf{202}_4$. At the end of the fifth cycle, the shift rate signal 103 causes bits $\mathbf{202}_1$–$\mathbf{202}_3$ to shift towards the right. The value formerly stored in the capture bit $\mathbf{202}_4$ is also shifted to bit $\mathbf{202}_3$. The capture bit $\mathbf{202}_4$ thereafter contains a "0". Since bit $\mathbf{202}_1$ contained a "0", the counter 112 is unchanged and will continue to reflect a count of zero (0). As a result of the shift signal, the register now indicates a history value of "0100", in binary or a hexadecimal value of "4".

During the period 402, no monitored event occurred. However, at the end of the tenth cycle a shift signal 103 is received and the register is shifted once again. As a result of the shift signal, the register now indicates a history value of "0010" in binary or a hexadecimal value of "2".

During the period 403, a monitored event occurred during the fourteenth cycle and is captured by bit $\mathbf{202}_4$. As such, the value stored in the register now reflects the binary value "1010" or a hexadecimal value of "A". Although a monitored event occurred during the fifteenth cycle, the capture bit already has a "11" due to the previous event signal. As such, the event signal of the fifteenth cycle does not affect the capture bit $\mathbf{202}_4$. At the end of the fifteenth cycle, a shift signal is received and bits $\mathbf{202}_1$–$\mathbf{202}_3$ are shifted towards the right. The capture bit $\mathbf{202}_4$ moves to the bit $\mathbf{202}_3$. Thus the history value 420 now reflects a binary value of "0101" or a hexadecimal value of "5".

During period 404, a monitored event occurred during the eighteenth cycle. As a result, the capture bit $\mathbf{202}_4$ contains a "1" and the history value reflects a binary value of "1101" or a hexadecimal value of "D." As described above, subsequent occurrences of monitored events during the same period do not affect the value stored in the capture bit $\mathbf{202}_4$. At the end of the twentieth cycle a shift signal is received. The history value now reflects a binary value of "0110" or a hexadecimal value of "6". Additionally, since bit 202, contained a "1" that was shifted out of the register at the end of the twentieth cycle, it causes the value "1" to be transmitted to the counter 112 as a count enable signal 110. Thus, the counter 112 is incremented to a value of 1.

During period 405, no monitored event occurred. At the end of the twenty-fifth cycle, a shift signal is received and bits $\mathbf{202}_1$–$\mathbf{202}_3$ are shifted towards the right, while the capture bit $\mathbf{202}_4$ moves to the bit $\mathbf{202}_3$. The history value now reflects a binary value of "0011" or a hexadecimal value of "3".

During period 406, a monitored event occurred during the twenty-seventh cycle. As a result, the capture bit $\mathbf{202}_4$ contains a "1" and the history value now reflects a binary value of "1011" or a hexadecimal value "B". A shift signal is received at the end of the 30th cycle resulting in a binary history value of "0101", or a hexadecimal value of "5". Additionally, since bit $\mathbf{202}_1$ contained a "1" that was shifted out of the register at the end of the 30th cycle, it causes the value "1" to be transmitted to the counter 112 as a count enable signal 110. Thus, the counter 112 is incremented to a value of 2.

During period 407, a monitored event occurred during the thirty-third cycle. As a result, the capture bit $\mathbf{202}_4$ contains a "1" and the history value now reflects a binary value of "1101" or a hexadecimal value "D". The shift signal is received at the end of the thirty-fifth cycle and causes the history value 420 to reflect a binary value of "0110" or a hexadecimal value of "6". Additionally, since bit $\mathbf{202}_1$ contained a "1" that was shifted out of the register at the end of the 35th cycle, it causes the value "1" to be transmitted to the counter 112 as a count enable signal 110. Thus, the counter 112 is incremented to a value of 3.

During period 408, no monitored event occurred. However, at the end of the fortieth clock cycle a shift signal is received and bits $\mathbf{202}_1$–$\mathbf{202}_3$ are shifted towards the right, while the capture bit $\mathbf{202}_4$ moves to the bit $\mathbf{202}_3$. The history value now reflects the binary value "0011" or a hexadecimal value "3" and the counter 112 remains at 3.

During period 409, no monitored event occurred. However, at the end of the forty-fifth clock cycle, a shift signal is received and bits $\mathbf{202}_1$–$\mathbf{202}_3$ are shifted towards the right, while the capture bit $\mathbf{202}_4$ moves to the bit $\mathbf{202}_3$. The history value now reflects a binary value of "0001" or a hexadecimal value of "11" and the counter 112 is incremented by 1 to a value of 4.

During the period 410, a monitored event occurred during the forty-sixth cycle. As such, the history value 420 now reflects a binary value of "1001" or a hexadecimal value of "9". At the end of the fiftieth cycle, a shift signal is received and bits $\mathbf{202}_1$–$\mathbf{202}_3$ are shifted towards the right, while the capture bit $\mathbf{202}_4$ moves to the bit $\mathbf{202}_3$. The history value now reflects the binary value "0100" or a hexadecimal value of "4" and the counter 112 is incremented by 1 to a value of 5.

During period 411, no monitored event occurred. At the end of the fifty-fifth clock cycle a shift signal is received and bits $\mathbf{202}_1$–$\mathbf{202}_3$ are shifted towards the right, while the capture bit $\mathbf{202}_4$ moves to the bit $\mathbf{202}_3$. The history value now reflects a binary value of "0010" or a hexadecimal value of "2" and the counter 112 remains at a value of 5.

During period 412, no monitored event occurred. At the end of the sixtieth clock cycle, a shift signal is received and bits $\mathbf{202}_1$–$\mathbf{202}_3$ are shifted towards the right, while the capture bit $\mathbf{202}_4$ moves to the bit $\mathbf{202}_3$. The history value now reflects a binary value of "0001" or a hexadecimal value of "1" and the counter 112 remains at a value of 5.

Upon viewing the history value of the register for any given period 401–412, one can determine which recent time interval (e.g., within the last four time intervals in this illustrative example) that one or more monitored events may have occurred. For example, observing the history value at the beginning of period 412, it is apparent that at least one monitored event occurred three periods ago (i.e., at period 410).

In addition, reading counter 112 at the same period 412 will reveal that a total of five (5) monitored events have occurred. The sixth occurrence has been captured within the register, but has yet to be counted by the counter 112. Clearly, a total of 14 monitored events occurred during the 60 clock cycles. However, the present invention now provides an efficient and inexpensive apparatus for monitoring occurrences of events where it is capable of providing an occurrence history of the monitored events with a reasonable granularity, e.g., a reduced granularity.

Figure 3:
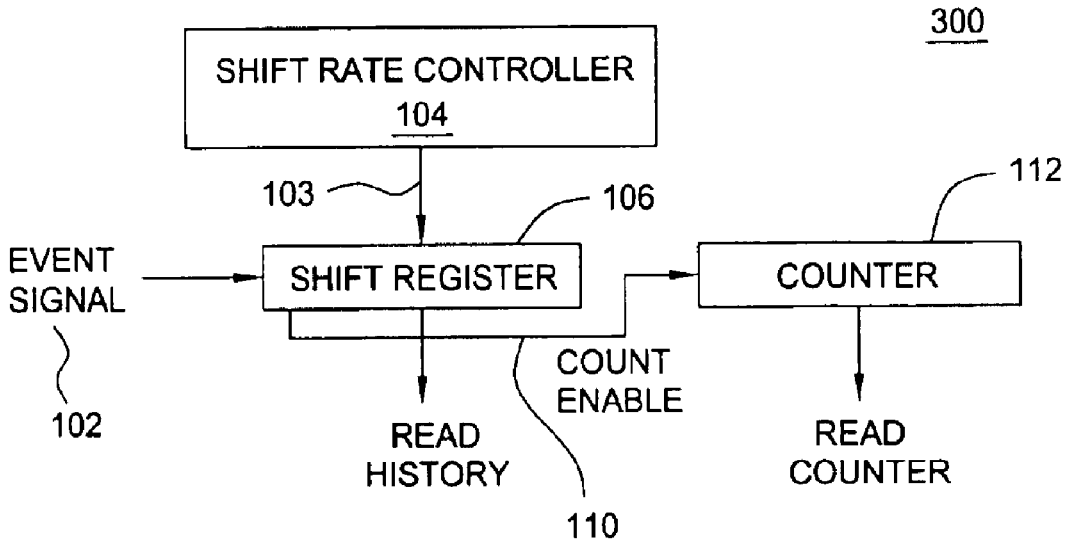
FIG. 3 is a block diagram of another embodiment of the apparatus for monitoring event occurrences in accordance with the present invention.

FIG. 3 is a block diagram of another embodiment of the apparatus 300 for monitoring event occurrences in accordance with the present invention. Specifically, FIG. 3 depicts shift register 106 which receives a shift rate signal 103 from a shift rate controller 104 and an event signal 102. Unlike the system of FIG. 1, the shift register 106 of FIG. 3 transmits a count enable signal 110 to the counter 112 from a different bit location. Namely, the count enable signal 110 is sent to the counter when the capture bit $\mathbf{202}_4$ captures the bit of information indicative of the occurrence of the monitored event. Thus, information indicative of the occurrences of the monitored event can be sent to the counter 112 prior to the information passing through all of the bits of the register. Using the example of the FIG. 4, the counter would reflect a value of 6 instead of 5 at the end of period 412.

Figure 6:
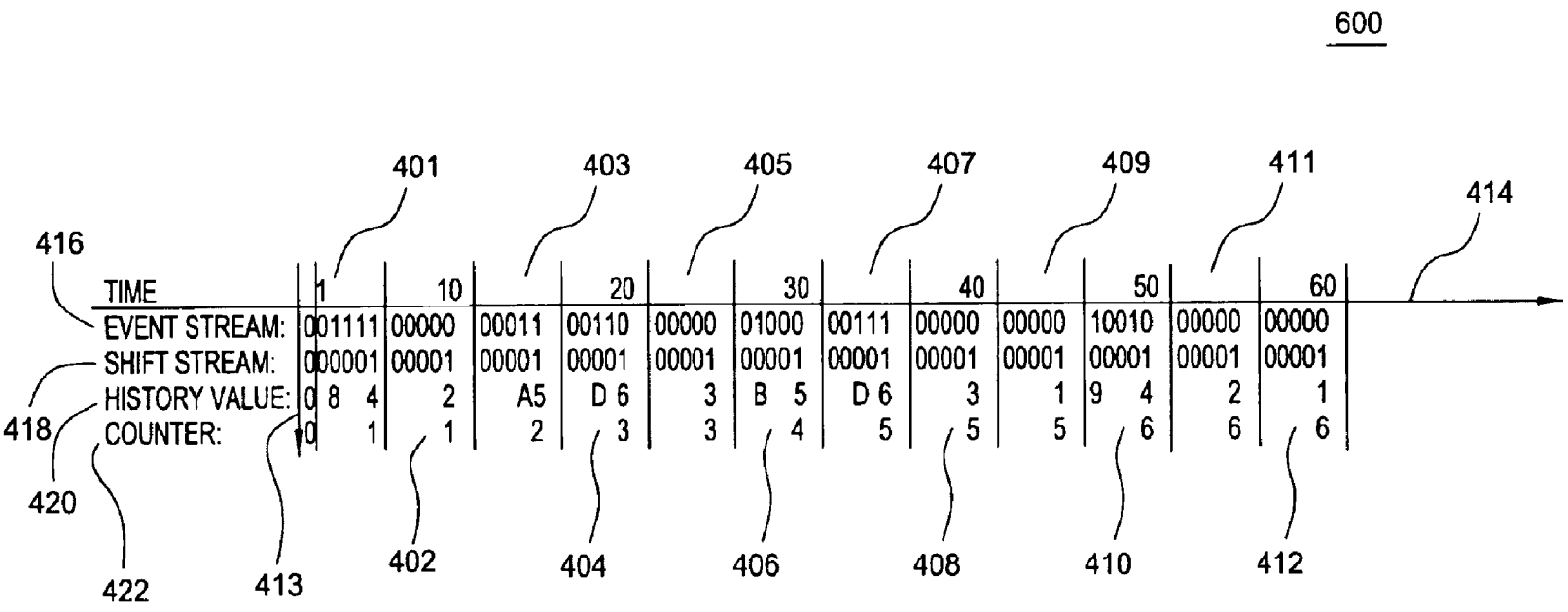
FIG. 6 is a graph in accordance with the embodiment of FIG. 3.

To further illustrate the embodiment of FIG. 3, a timing diagram is again provided in FIG. 6. It should be noted that the values for event stream 416, shift stream 418 and history value 420 are identical to those shown in FIG. 4. However, the difference is in the timing with which the counter is informed about the occurrence of the monitored event. Namely, the counter value 422 is informed immediately within each time period that a monitored event has occurred, e.g., when a bit is captured by the capture bit $\mathbf{202}_4$. Thus, the counter value stream 422 is different between FIGS. 4 and 6. The description for the timing diagram for FIG. 6 is identical to FIG. 4 with the exception as to when the count enable signal 110 is forwarded to the counter so that the count can be incremented.

Figure 5:
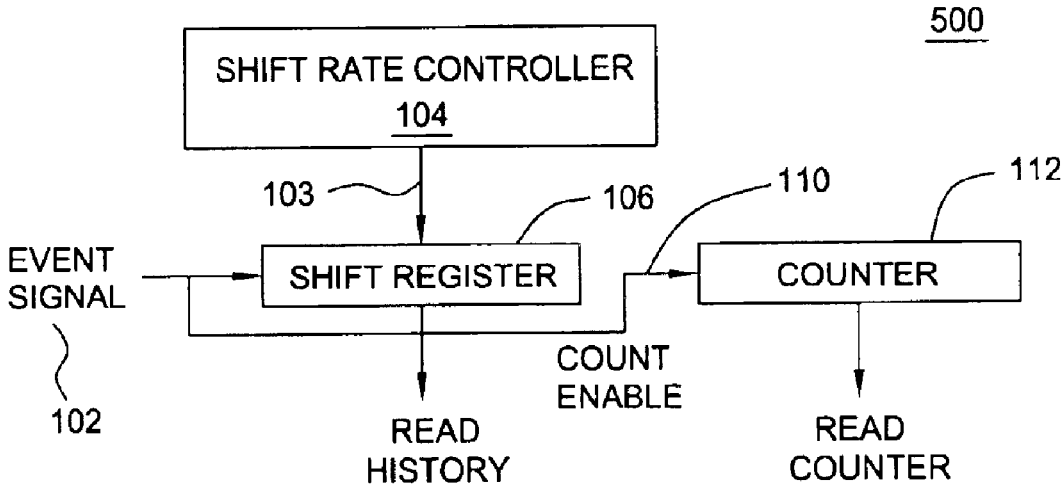
FIG. 5 is a block diagram of yet another embodiment of the apparatus for monitoring event occurrences in accordance with the present invention.

FIG. 5 illustrates yet another apparatus 500 for monitoring event occurrences of the present invention. Specifically, FIG. 5 depicts an embodiment where the event signal 102 is simultaneously transmitted to the counter 112 (as a count enable signal 110). The capture bit $\mathbf{202}_4$ is still operated in a manner as discussed above to provide a reduced granularity of the recent history pattern. However, counter 112 is now receiving the information directly from the event signal that is not filtered by the register 106. In other words, all the occurrences of the monitored events will be counted. Thus, using the example as illustrated in FIG. 4, the counter 112 will now record a value of 14 at the end of period 412.

Figure 7:
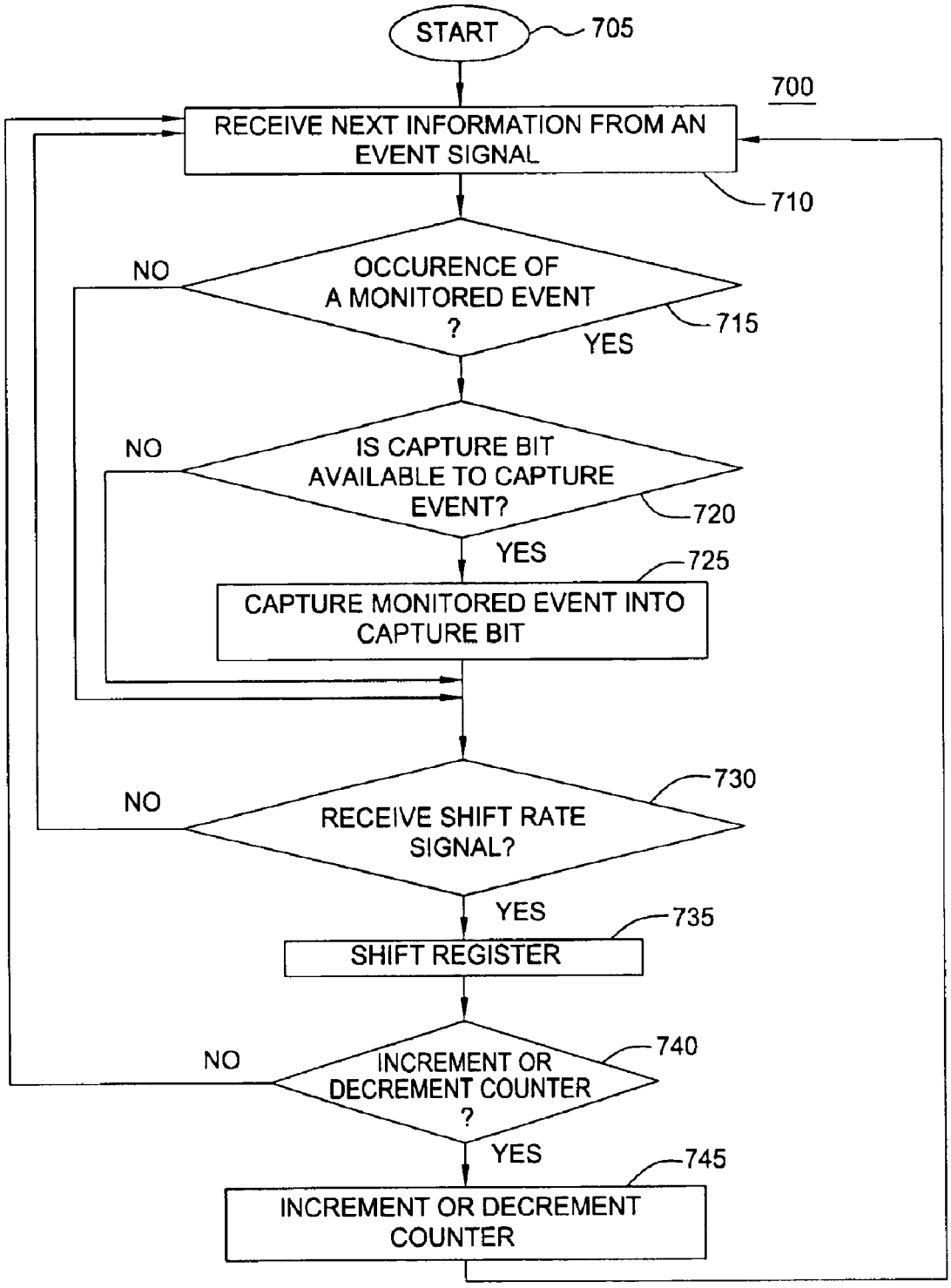
FIG. 7 is a monitoring method in accordance with the present invention.

FIG. 7 is a monitoring method 700 in accordance with the present invention. The method 700 begins at step 705 and proceeds to step 710.

In step 710, method 700 receives the next information (e.g., the next bit) from an event signal. If method 700 just started, then the method receives a first bit instead of a next bit of information from the event signal.

In step 715, method 700 queries whether the received information represents an occurrence of a monitored event. If the query is negatively answered, then method 700 returns to step 710, where the next information from the event signal is received. If the query is positively answered, then method 700 proceeds to step 720. Alternatively, it is possible to immediately proceed to step 745 via the dashed line to increment or decrement the counter. This alternate path illustrates the embodiment as illustrated in FIG. 5.

In step 720, method 700 queries whether the capture bit is available to capture the information representative of the occurrence of the monitored event. If the query is negatively answered, then method 700 returns to step 710, where the next information from the event signal is received. If the capture bit is full, then it will not be available to capture any additional data at this point. If the query is positively answered, then method 700 proceeds to step 725.

In step 725, the information representative of the occurrence of the monitored event is captured in the capture bit. Alternatively, it is possible to immediately proceed to step 745 via the dashed line to increment or decrement the counter. This alternate path illustrates the embodiment as illustrated in FIG. 3.

In step 730, method 700 queries whether a shift signal is received. If the query is negatively answered, then method 700 returns to step 710, where the next information from the event signal is received. Namely, the previously defined time interval has yet to elapse. If the query is positively answered, then method 700 proceeds to step 735, where the register is shifted.

In step 740, method 700 queries whether the counter should be incremented or decremented. Namely, method 700 is evaluating whether the bit shifted out of the register indicates the occurrence of the monitored event. If the query is negatively answered, then method 700 returns to step 710, where the next information from the event signal is received. If the query is positively answered, then method 700 proceeds to step 745, where the counter is incremented or decremented. This manner of controlling the counter reflects the embodiment of FIG. 1.

In step 750, method 700 queries whether there is additional information in the event signal. If the query is positively answered, then method 700 returns to step 710, where the next information from the event signal is received. If the query is negatively answered, then method 700 ends in step 755.

Figure 8:
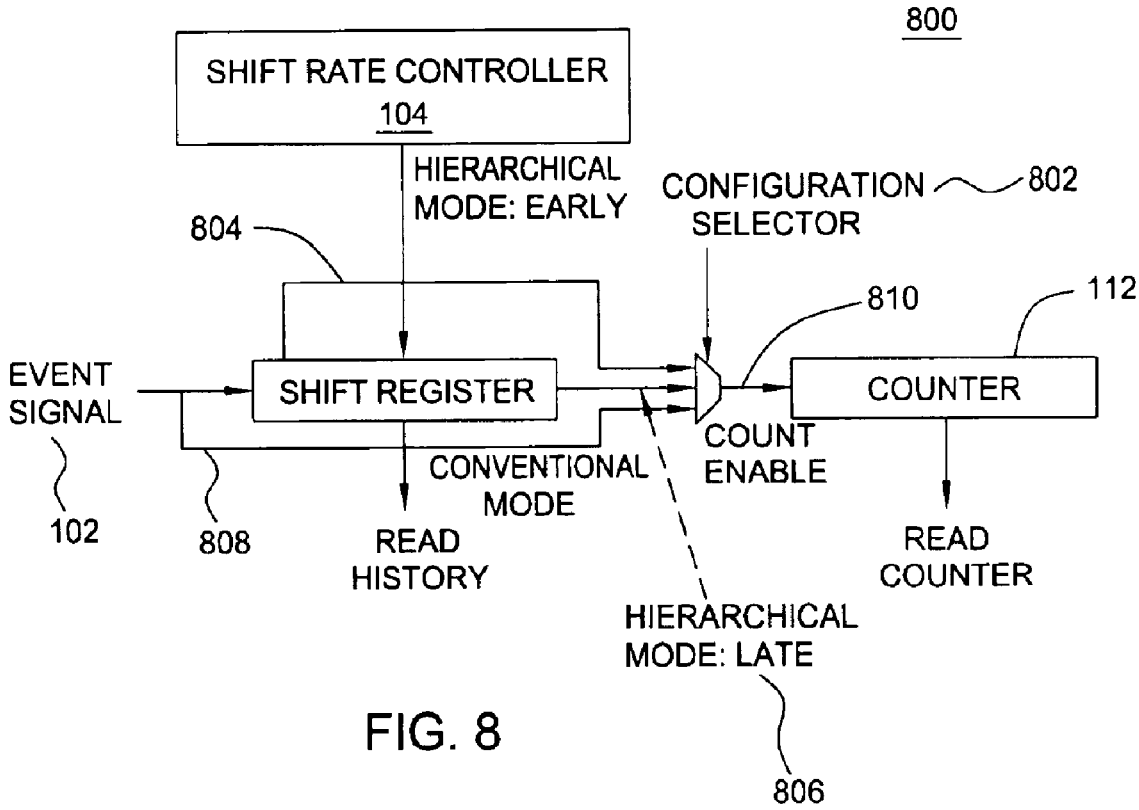
FIG. 8 is another embodiment of an apparatus for monitoring event occurrences in accordance with the present invention.

FIG. 8 depicts another apparatus 800 for monitoring event occurrences of the present invention. Specifically, FIG. 8 depicts apparatus 800 that contains all three embodiments depicted in FIGS. 1, 3 and 5. Similar elements depicted in FIG. 8 have been previously described with respect to FIGS. 1, 3 and 5. As such and for brevity a recitation of those elements will not be repeated. However, it is noted that lead lines 804 (hierarchical mode: early), 806 (hierarchical mode: late) and 808 (conventional mode) depict the count enable signals previously described in FIGS. 1, 3 and 5, respectively. In addition, FIG. 8 also depicts a configuration selector 802 which allows any one of three modes to be selectively applied.

Figure 9:
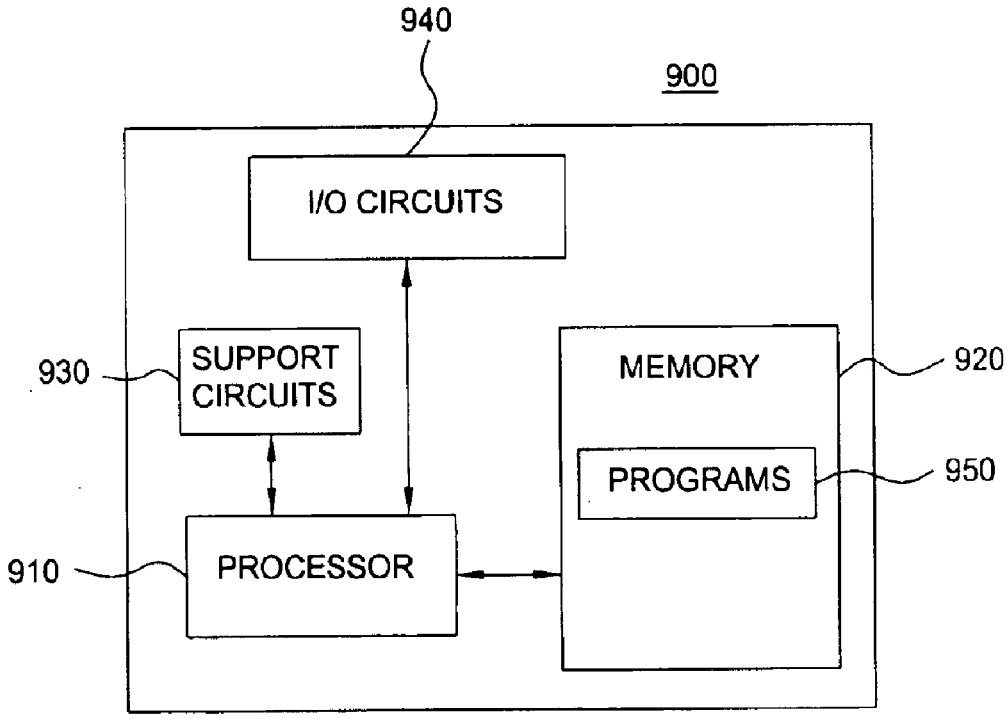
FIG. 9 is a block diagram of a system in accordance with the present invention.

FIG. 9 depicts a high level block diagram of the present invention implemented using a general purpose computing device 900. In one embodiment, general purpose computing device 900 comprises a processor 910, a memory 920 for storing programs 950, data and the like, support circuits 930, and Input/Output (I/O) circuits 940. The processor 910 operates with conventional support circuitry 930 such as power supplies, clock circuits, and the like. Additionally, processor 910 also operates with a plurality of I/O circuits or devices 940 such as a keyboard, a mouse, a monitor, a storage device such as a disk drive and/or optical drive and the like. In one embodiment, the present apparatus and method for monitoring event occurrences can be adapted as a software application that is retrieved from a storage device 940 that is loaded into the memory and is then executed by the processor 910.

As such, it is contemplated that some and/or all of the steps of the above methods and data structure as discussed above can be stored on a computer-readable medium.

Alternatively, the present apparatus for monitoring event occurrences can be implemented, in part or in whole, in hardware, for example, as an application specific integrated circuit (ASIC). As such, the process steps described herein are intended to be broadly interpreted as being equivalently performed by software, hardware, or a combination thereof.

In the above description, the invention is described with respect to a four bit shift register. However, this illustrative depiction is not intended in any way to limit the scope of the invention. For example, the invention can be implemented with a shift register having less or more bits (e.g. three bits, five bits, six bits and so on). In addition, the shift register is described above as shifting towards the right and the counter is described as an incrementing counter, however, it is appreciated that the invention may be adapted to shift left and the counter may also be a decrementing counter to suit a particular implementation. For example, the counter can be used to monitor a specific number of occurrences of a monitored event, where a decrementing countering scheme is more appropriate.

Additionally, in one embodiment, it is possible to omit the counter in accordance with a particular application. Furthermore, it is also possible to employ more than one capture bit within the register in accordance with a particular application.

While the foregoing is directed to embodiments of the present invention, other and further embodiments of the invention may be devised without departing from the basic scope thereof, and the scope thereof is determined by the claims that follow.

What is claimed is:

1. Method for monitoring event occurrences using a register having at least one capture bit with a plurality of storage bits and a counter, said method comprising:

a) receiving information from an event signal indicative of an occurrence of a monitored event by the register, wherein said event signal is received at a first frequency;

b) capturing said information into the at least one capture bit of the register; and c) shifting said stored information in said at least one capture bit to one of the plurality of storage bits in accordance with a shift rate signal, wherein said shift rate signal is received at a second frequency.

2. The method of claim 1, further comprising:

d) determining whether shifted information from the register is to effect counting by the counter.

3. The method of claim 2, wherein said second frequency is dependent upon a selectable time interval, and wherein said first frequency is different than said second frequency.

4. The method of claim 2, further comprising:

e) causing the counter to count if said shifted information from the register is indicative of an occurrence of a monitored event.

5. The method of claim 2, wherein said shifted information is received from the at least one capture bit of the register.

6. The method of claim 2, wherein said shifted information is received from one of the plurality of storage bits of the register.

7. The method of claim 1, further comprising:

d) determining whether information directly from the event signal is to effect counting by the counter.

8. The method of claim 7, further comprising:

e) causing the counter to count if said information directly from the event signal is indicative of an occurrence of a monitored event.

9. The method of claim 1, wherein the register has a length of four bits.

10. The method of claim 1, further comprising:

d) selecting between a plurality of counting methods, where a first counting method determines whether shifted information from the at least one capture bit of the register is to effect counting by the counter, where a second counting method determines whether shifted information from one of the plurality of storage bits of the register is to effect counting by the counter, and where a third counting method determines whether information directly from the event signal is to effect counting by the counter.

11. Apparatus for monitoring event occurrences, comprising:

a register having at least one capture bit with a plurality of storage bits for receiving and capturing information from an event signal indicative of an occurrence of a monitored event, wherein said event signal is received at a first frequency; and a shift rate controller for generating a shift rate signal, wherein said stored information in said at least one capture bit is shifted to one of the plurality of storage bits in accordance with said shift rate signal, wherein said shift rate signal is received by the register at a second frequency.

12. The apparatus of claim 11, further comprising:

a counter for determining whether shifted information from the register is to effect counting by said counter.

13. The apparatus of claim 12, wherein said second frequency is dependent upon a selectable time interval, and wherein said first frequency is different than said second frequency.

14. The apparatus of claim 12, wherein said counter counts if said shifted information from the register is indicative of an occurrence of a monitored event.

15. The apparatus of claim 12, wherein said shifted information is received from the at least one capture bit of said register.

16. The apparatus of claim 12, wherein said shifted information is received from one of the plurality of storage bits of said register.

17. The apparatus of claim 11, further comprising:

a counter for determining whether information directly from the event signal is to effect counting by said counter.

18. The apparatus of claim 17, wherein said counter counts if said information directly from the event signal is indicative of an occurrence of a monitored event.

19. The apparatus of claim 11, wherein the register has a length of four bits.

20. The apparatus of claim 11, further comprising:

a selector for selecting between a plurality of counting methods, where a first counting method determines whether shifted information from the at least one capture bit of the register is to effect counting by the counter, where a second counting method determines whether shifted information from one of the plurality of storage bits of the register is to effect counting by the counter, and where a third counting method determines whether information directly from the event signal is to effect counting by the counter.

21. A computer-readable medium having stored thereon a plurality of instructions, the plurality of instructions including instructions which, when executed by a processor, cause the processor to perform the steps of a method for monitoring event occurrences using a register having at least one capture bit with a plurality of storage bits and a counter, comprising the steps of:

a) receiving information from an event signal indicative of an occurrence of a monitored event by the register, wherein said event signal is received at a first frequency;

b) capturing said information into the at least one capture bit of the register; and c) shifting said stored information in said at least one capture bit to one of the plurality of storage bits in accordance with a shift rate signal, wherein said shift rate signal is received at a second frequency.

22. The computer-readable medium of claim 21, further comprising:

d) determining whether shifted information from the register is to effect counting by the counter.

23. The computer-readable medium of claim 22, wherein said second frequency is dependent upon a selectable time interval, and wherein said first frequency is different than said second frequency.

24. The computer-readable medium of claim 22, further comprising:

e) causing the counter to count if said shifted information from the register is indicative of an occurrence of a monitored event.

25. The computer-readable medium of claim 22, wherein said shifted information is received from the at least one capture bit of the register.

26. The computer-readable medium of claim 22, wherein said shifted information is received from one of the plurality of storage bits of the register.

27. The computer-readable medium of claim 21, further comprising:

d) determining whether information directly from the event signal is to effect counting by the counter.

28. The computer-readable medium of claim 27, further comprising:

e) causing the counter to count if said information directly from the event signal is indicative of an occurrence of a monitored event.

29. The computer-readable medium of claim 21, wherein the register has a length of four bits.

30. The computer-readable medium of claim 21, further comprising:

d) selecting between a plurality of counting methods, where a first counting method determines whether shifted information from the at least one capture bit of the register is to effect counting by the counter, where a second counting method determines whether shifted information from one of the plurality of storage bits of the register is to effect counting by the counter, and where a third counting method determines whether information directly from the event signal is to effect counting by the counter.

* * * * *